United States Patent [19]

Tanaka

[11] Patent Number: 4,819,941

[45] Date of Patent: Apr. 11, 1989

[54] DEVICE FOR DETERMINING SWING SPEED OF ROTATABLE IMPLEMENTS

[75] Inventor: Yoshihisa Tanaka, Tokyo, Japan

[73] Assignee: Tanaka Manufacturing Co., Ltd., Tokyo, Japan

[21] Appl. No.: 77,354

[22] Filed: Jul. 24, 1987

[30] Foreign Application Priority Data

Jul. 25, 1986 [JP] Japan ..... 61-114216[U]

[51] Int. Cl.[4] ..... A63B 69/00; A63B 69/36; G01L 5/06

[52] U.S. Cl. ..... 293/186 A; 273/26 B; 73/381; 73/380

[58] Field of Search ..... 273/186 A, 186 R, 186 D, 273/193 R, 194 B, 194 R, 26 B; 73/379, 380, 381

[56] References Cited

U.S. PATENT DOCUMENTS

| | | | |
|---|---|---|---|
| 1,492,039 | 4/1924 | Leven | 273/186 A |
| 2,501,277 | 3/1950 | Hollopeter | 273/186 A |
| 2,630,012 | 3/1953 | Walker | 273/186 A |
| 2,772,887 | 12/1956 | Blake | 273/26 B X |
| 3,113,781 | 12/1963 | Guier | 273/186 A |
| 3,136,546 | 6/1964 | Connolly | 273/186 A X |
| 3,172,668 | 3/1965 | Blake | 273/186 A |
| 3,753,564 | 8/1973 | Brandell | 273/186 A |
| 3,848,873 | 11/1974 | Linning | 273/186 A |
| 4,027,535 | 6/1977 | Swanson | 73/381 |

FOREIGN PATENT DOCUMENTS 49-12125 3/1974 Japan .

*Primary Examiner*—Leonard E. Smith
*Assistant Examiner*—Robert Blackmon
*Attorney, Agent, or Firm*—David H. Semmes

[57] ABSTRACT

A device for determining swing speed of a rotatable sporting goods implement, for example human activated sporting goods i.e. a baseball bat or a golf club, wherein practice swings are undertaken seriatim. The device is comprised of a base mounted support for a rotatable screw shaft, an adjustor that is threadedly engaged with said screw shaft to enable its segmental rotation when the screw shaft is rotated, a movable member swingingly supported to the base and connected via a spring to the adjustor, which enables determination of the maximum swing speed by the tension of the spring that connects the adjustor and the movable member, causing movement of the movable member by induced centrifugal force at the time of swinging. There is also a stopper upon which the movable member may impinge to thus produce a hitting sound.

2 Claims, 2 Drawing Sheets

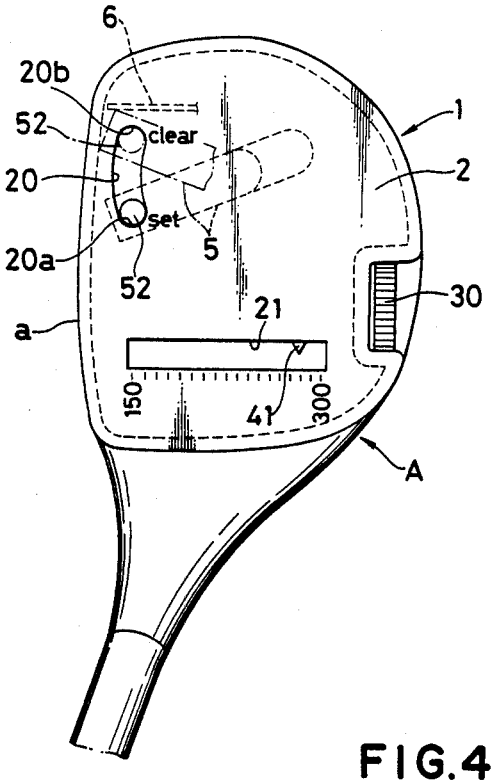
FIG.3
FIG.4
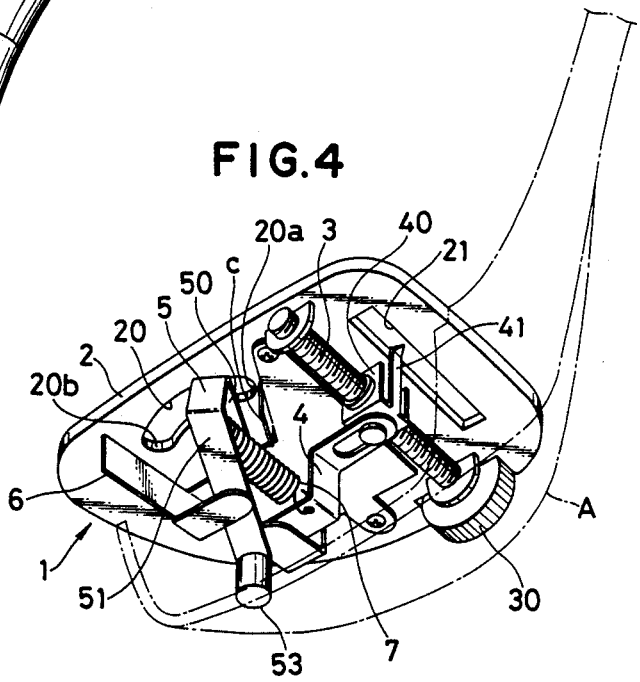

DEVICE FOR DETERMINING SWING SPEED OF ROTATABLE IMPLEMENTS

BACKGROUND OF THE INVENTION

1. Field of the Invention

The present invention relates to a device for determining speed when sporting goods implements, particularly, such as a golf club, a baseball bat, etc is swung.

2. Description of the Prior Art

Devices used to measure swing speed or the like of a golf club or a baseball bat heretofore proposed include, for example, a needle-movable type in which a spring is extended by a centrifugal force produced at the time of swing to move a needle, and after swinging has been finished, the spring is returned to its original position with the result that the needle remains stopped at a position in which it has moved to determine the maximum centrifugal force (head speed) (see Japanese Utility Model Application Laid-open Nos. 60-7,858 and 60-32,972); a system in which the sound through the air is produced by air resistance caused by swinging (see Japanese Utility Model Application No. 60-30,267); a system in which a propeller is provided, and a measured value is calculated from rotation of the propeller (see Japanese Patent Publication No. 51-10,536); and a system in which a centrifugal force produced when swinging is made is applied to a weight being normally tensioned by means of a spring to rotate the weight which then comes into contact with a stopper thereby determining whether or not a set swing speed comes out (see Japanese Utility Model Publication No. 49-12,125).

However, the above-described conventional devices have been proposed to measure a swing speed to calculate a distance covered or flow, or to merely determine whether or not a set swing speed was reached, but were not possible to find whether or not the maximum speed (maximum accleration) as reached at a reasonable position in a swinging orbit, and what that speed it was. That is, there has been encountered problems that swinging in the proper form suitable for respective players cannot be determined; and in addition, a player is apt to swing with all his strength and when measurement is made, his swing form tends to get out of shape.

SUMMARY OF THE INVENTION

The present invention has been achieved in view of those problems noted above with respect to prior art. According to the present invention, there is provided a device for determining swing speed provided on a swing practice goods in the form of a sporting goods for swinging such as a golf club, the device comprising a screw shaft rotatably supported on a base mounted on the practice goods, an adjustor having one end threadedly engaged with said screw shaft to effect segmental rotation by rotation of the screw shaft, a movable member swingingly supported on said base and connected to said adjustor through a spring, and a stopper on which said movable member impinges to produce a hitting sound. The present invention overcomes the aforementioned problems encountered in prior art.

The present invention enables to determination of the maximum speed at the time of swinging according to whether or not the movable member, which is positioned by tension of the spring connecting the adjustor and movable member, is moved by the centrifugal force at the time of swinging, to produce a hitting sound by movement of the movable member to impinge upon the stopper, and to rotate the screw shaft to move the adjustor to vary the tension of the spring.

BRIEF DESCRIPTION OF THE DRAWINGS

The device according to the present invention will be described hereinafter with reference to the accompanying drawings, in which:

FIG. 3 is an explanatory view showing, from the top side, the mounting state; and FIG. 4 is an explanatory view showing, from the rear side, the mounting state.

DETAILED DESCRIPTION OF THE PREFERRED EMBODIMENT

Figure 1:
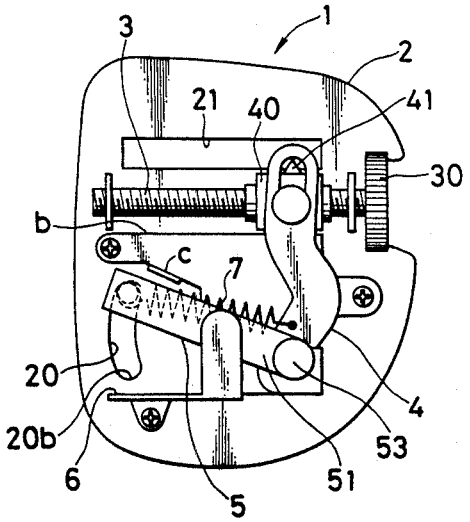
FIG. 1 is an explanatory view showing, from the lower side, an embodiment of a device for determining swing speed of rotatable implements according to the present invention.

The present invention will be described in detail on the basis of an embodiment shown in which the invention is applied to a golf swing practice goods.

A device for determining swing speed of rotatable implements provided in a depressed portion with a head body of a practice goods depressed is indicated generally at 1. The device for determining swing speed of rotatable implements 1 comprises a lid member for a head body A, a base 2 fixedly mounted on the head body, a screw shaft 3, an adjustor 4, a movable member and a stopper 6. The screw shaft 3 is rotatably supported on the base 2 and can be rotated by means of a knob 30 positioned on the rear inflated side of the head body A. The adjustor 4 is rotatable mounted on a support member b secured to the base plate 2, and a threadedly engaging portion 40 provided on the end thereof threadedly engages the screw shaft 3, which screw shaft 30 is rotated so that the adjustor 4 takes a segmental rotation in a direction orthogonal to a face surface a by the rotation of the screw shaft 3.

Figure 2:
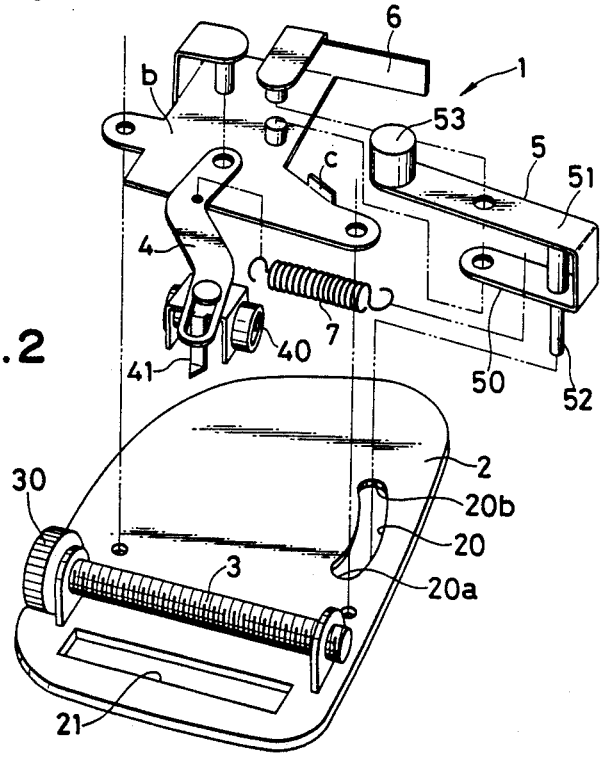
FIG. 2 is an explanatory view showing, from the rear side, the state in which the device is exploded.

The movable member 5 is a horizontal U-shaped element, one leg of which is elongated relative to the other and has a balancer on the end, in which as shown in FIG. 2 showing the exploded state as viewed from the rear side, an upper leg 50 and a lower leg 51 are connected to a support member b secured to the base 2, the movable member 5 being supported swingingly in a direction of the ball striking face surface a. A pin 52 provided on the upper leg 50 is projected upwardly of the head body A through a slot longitudinally oriented 20 formed in the base 2, and the movable member 5 may be moved about the pin 52 in the swinging range defined by a stopper 6 later described and a defining member c positioned corresponding to an end 20*a* of the slot 20. The movable member 5 has a balancer 53 provided on the lower leg 51.

The stopper 6 is provided integral with the support member b and fixedly mounted to be positioned corresponding to one end 20*b* of the slot 20. The movable member 5 swings to impinge upon the stopper 6 to thereby position the movable member 5 and to produce a hitting sound.

The movable member 5 is also connected to the adjustor 4 through a spring 7 disposed between the upper 50 and the lower part 51. Tension is always applied in the direction of the adjustor 4 by means of said spring 7, and the movable member 5 is fixedly positioned in a state urged toward either side of the swinging range, that is, toward either the shaft side (the centripetal side at the time of swinging) or the outer end side of the head body A (the centrifugal side at the time of swinging), whereby the state wherein the upper leg 50 engages the end 20*a* of the slot 20 and the state wherein the movable member 5 abuts against the stopper 6 are maintained.

With this arrangement, the adjustor 4 takes its segmental rotation by rotation of the screw shaft 3, and the variation in the spring length allows variation of the tension in spring 7, whereby the head speed may be suitably set when the movable member 5 starts its movement (movement from the shaft side toward the outward side). That is, a limit of tension is varied with respect to the centrifugal force (inertia force) produced in the movable member 5 at the time of swinging, and the range of determination (the range of the top speed) can be set extensively according to the ability of players from the junior class to an higher class.

The base 2 is provided with a graduated portion 21 formed from a slot opening along the screw shaft 3, and a pointer 41 of the threadedly engaging portion 40 of the adjustor 4 corresponds to the graduation portion 21 so that the head speed being set may be read from the graduations pointed by the pointer 41.

In deciding the swing speed by using the device for determing swing speed of rotatable implements constructed as described above, the pin 52 is swung while adjusting to the "Set" position of the slot 20, and when the centrifugal force caused by the swing is applied to the movable member 5 being positioned in the state urged toward the shaft by the tension of the spring 7 and this centrifugal force overcomes the tension of the spring 7, the movable member 5 moves and impinges upon the stopper 6 to produce a hitting sound and the pin 52 reaches the position "CLEAR" of the slot 20*b*, thus deciding that the swing speed is over the speed (graduations) indicated by the pointer 41. In the case where the tension set by the adjustor 4 is greater than the centrifugal force, that is, in the case where the swing speed is less than the set speed which is a target, the movable member 5 is not moved on the shaft side and the pin 52 remains in the position "Set". It is possible to determine by the pin 52 that the swing speed (the maximum speed) is less than the set speed.

Since the movable member 5 impinges upon the stopper 6 to produce a hitting sound, it is possible to judge that at what part of the swinging orbit the head speed reached the maximum speed, and comparison between the speed-change of the head as a model and the speed-change of the head at the time of swinging may also be effected.

While in the above-described embodiment, a device for determining swing speed of rotatable implements which is concealed in a golf club head body has been illustrated, it is to be noted that the present invention is not limited thereto but the device can be provided on a practice goods like the form of a baseball bat. Moreover, this device for determining swing speed of rotatable implements can be attached later to a golf club or a baseball bat.

As described above, according to the present invention, a device for determining swing speed of rotatable implements is designed so that one end of the adjustor threadedly engages the screw shaft rotatably supported on the base, the adjustor takes its segmental rotation by the rotation of the screw shaft, and when the movable member swingingly supported on the base and connected to the adjustor through the spring is moved against the tension thereof, it impinges upon the stopper to produce a hitting sound. Only when the centrifugal force produced at the time of swinging is greater than the tension applied to the movable member, the movable member moves. Therefore, whether or not the head speed is greater than the set speed at the time of swinging can be judged easily from the position of the movable member. In addition, the tension may be varied by adjustment of the threaded engagement of the adjustor to easily set the optimum speed according to the ability of respective players. The device is easy in handling.

Moreover, the maximum speed position of the swing may be easily found by the hitting sound; it can be judged that at what position of the swinging orbit the head speed reached the set speed or more; comparison between the speed-change of the head as a model and the speed-change of the head at the time of swinging can be made, thus being useful for making a swing form. Furthermore, this device is advantageous over the prior art due to its simplicity of construction, wherein the cost is reduced; moreover the device may be fabricated in substantially smaller dimension than those of the prior art, resulting in less cumbersome and lighter devices. The overall assemblage of this device permits the user of the practice goods to swing same without causing undesirable interference to the player's swing, per se.

What is claimed is:

1. A device for determining swing speed of a swingable practice sporting goods implement such as a golf club, wherein the practice of one's swing may be performed seriatim, comprising in combination with the sporting goods implement:

(A) a supporting base plate fixedly mounted horizontally within the head body of the implement, said base plate defining an longitudinally oriented arcuate slot therein, said base plate bearing (B) a rotatable screw-shaft secured upon the base plate in parallel relation thereto;

(C) a open-ended arcuately movable U-shaped member having opposed upper and lower legs of relative uneven length, the lower leg being longest and having a balancer adjacent an open end thereof, the upper leg being the shorter, said U-shaped member being pivot connected to the base, intermediate ends thereof and the respective legs having slidable pin contact with the arcuate slot of the base plate;

(D) an adjustor pivoted at one end to the base plate and threadedly connected at another end to said screw shaft to enable segmental rotation of the adjustor as the screw-shaft may be rotated, said adjustor having tension spring connection with the pin of the movable member, whereby determination of the maximum swing speed by tension of the spring upon the adjustor and the movable member causes a centrifugal force movement to the movable member during swinging of the implement and, (E) a stopper fixed to the base plate upon which the movable member may impinge to thus produce a hitting sound.

2. The device according to claim 1, wherein said base plate of the implement defines a transversely oriented graduated slot opening which enables the head speed to be read.

* * * * *